United States Patent [19]

Landem

[11] 4,381,046

[45] Apr. 26, 1983

[54] FIRE ESCAPE LADDER STORAGE AND DEPLOYMENT DEVICE

[75] Inventor: Roy H. Landem, Vernon Hills, Ill.

[73] Assignee: Ridge Products, Inc., Barrington, Ill.

[21] Appl. No.: 214,653

[22] Filed: Dec. 9, 1980

[51] Int. Cl.[3] ..... E06C 9/14; E06C 1/56

[52] U.S. Cl. ..... 182/70; 182/196

[58] Field of Search ..... 182/70, 76, 196, 197, 182/198, 199

[56] References Cited

U.S. PATENT DOCUMENTS

| | | | |
|---|---|---|---|
| 293,153 | 2/1884 | Downing | 182/70 |
| 672,206 | 4/1901 | Dodd | 182/70 |
| 2,709,030 | 5/1955 | Vroman | 182/163 |
| 3,012,626 | 12/1961 | Marryatt | 182/70 |
| 3,016,975 | 1/1962 | Gogol | 182/70 |
| 4,222,458 | 9/1980 | Pratt | 182/81 |
| 4,237,654 | 12/1980 | Landem | 182/76 |

FOREIGN PATENT DOCUMENTS

| | | | |
|---|---|---|---|
| 393 | of 1893 | United Kingdom | 182/70 |

*Primary Examiner*—Reinaldo P. Machado

*Attorney, Agent, or Firm*—Cook, Wetzel & Egan

[57] ABSTRACT

A fire escape ladder storage and deployment device comprises a series of interfitting cabinet sections adapted to be affixed to an interior surface of an exterior wall adjacent and beneath a window opening through the wall. In its closed position, the device stores a collapsible ladder such as a rope ladder within the compartment, and also provides a table-like working surface. In an emergency, an upper part of the device folds downwardly, away from the wall to reveal the ladder storage compartment and also to form a step above the floor level. An interior member which holds the ladder is then pivoted upwardly and through the window or door opening. The collapsible ladder can be tossed by hand through the open window first, or it can be deployed via the raising and pivoting of the interior member. Raising the interior member exposes a second step, on the wall mounting bracket, and also forms a third step through the window opening. The ladder than hangs to ground level from the interior member. In the alternative, a lowering cable on a reel and a chair or similar escape device may be stored in the compartment for use in place of a ladder as such.

3 Claims, 2 Drawing Figures

11
12
13
10
2
14
27
31
32
30
20
29
28
23
21
15
35
38
40
37
41
36
39
22
24
26
25
42

FIRE ESCAPE LADDER STORAGE AND DEPLOYMENT DEVICE

The present invention is related to and particularly useable with the Fire Escape Window System of my prior and co-pending application, Ser. No. 927,350, filed July 24, 1978 with Michael Connolly as co-applicant. That application is issuing as U.S. Pat. No. 4,237,654, on Dec. 9, 1980. Its disclosure is incorporated in full by reference herein.

The present invention relates to fire escape systems for use in private residences as well as in office, warehouse, and manufacturing facilities of two to eight or more stories.

My prior invention incorporates a ladder storage compartment in the base of the window opening, in a compartment 54 provided beneath the pivotable outer frame assembly. While that arrangement provides an immediately accessible escape ladder for use in an emergency, it may be somewhat difficult to incorporate into existing construction in some circumstances, as some reconstruction of the window opening area may be required. A prior U.S. Pat. No. 2,709,030, discloses a fire escape door which has a compartment in the lower portion of the door for a collapsed ladder. The ladder is automatically ejected from the compartment when the door is opened in an emergency and the various panels are swung to their escape positions.

In accordance with the principles of the present invention, an apparatus and method are disclosed for storing and deploying a ladder or similar escape or lowering device for affording emergency escape to a lower level from an elevated enclosure such as a room of a building. A cabinet is mounted on a wall below a window opening through an exterior wall of the a building. A collapsible ladder is stored in a compartment of the cabinet. In an emergency, the compartment is opened by pivoting a first, L-shaped member from a position covering the top and front of the compartment to a position forming a step outwardly of and below the compartment. A second, L- or U-shaped member holding the collapsible ladder is pivoted from its position within the compartment to a position extending through the window opening. The ladder is attached to and is deployed from the end of the second member, and extends from the opening level to the ground or a lower escape level.

Figures 1, 2, 3:
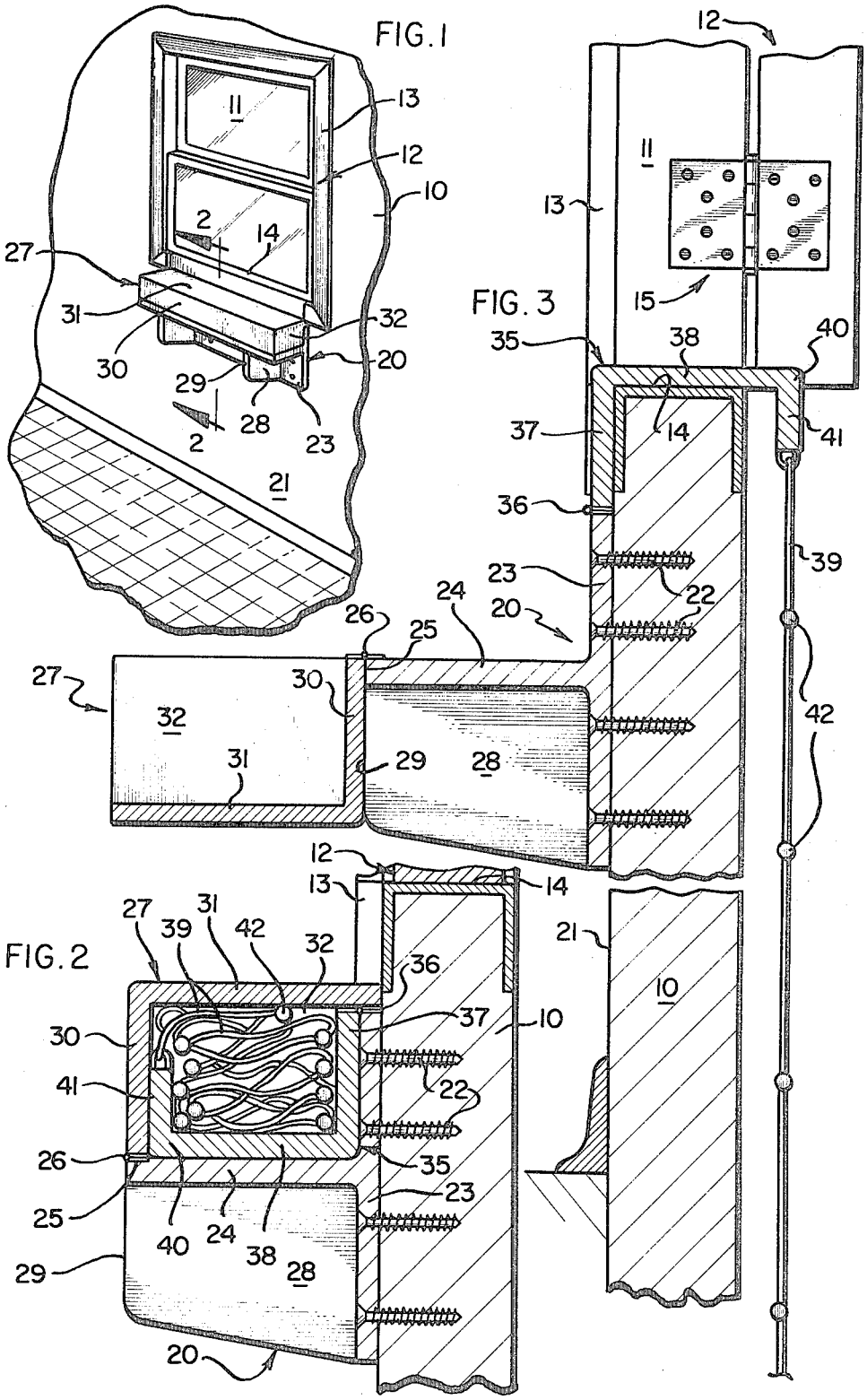
FIG. 1 is a general, perspective view of the device of the present invention in closed position, installed adjacent a window.
FIG. 2 is a side, sectional view taken on line 2—2 of FIG. 1, showing the several pivotable members of the cabinet in the storage position.
FIG. 3 is a side, sectional view similar to that of FIG. 2, but showing the device and ladder in its deployed position, for affording emergency escape.

A preferred form of my invention is shown in the drawings and is described as follows. An exterior wall 10 of a building has an opening 11 formed therein which is normally occupied by a window 12 comprising one or more panes of glass, sashes, screens, and the like, as is common in residential and commercial construction. A decorative frame 13 extends around the window 12, except possibly along its bottom edge 14 thereof.

The window 12 may be of entirely conventional construction, wherein a lower sash is raised sufficiently high to afford an emergency escape route, or the window 12 may comprise French windows (or doors) which open from the center, to provide in any event a more or less unobstructed escape passage. However, the preferred embodiment is that incorporating the fire escape window system of my soon-to-issue co-owned U.S. Pat. No. 4,237,654. Briefly, according to that invention, all the glass, sashes, screens, and the like within the opening 11 are mounted in an inner frame which in turn is pivoted upon an outer frame, as shown by a hinge 15. The elements of the window 12 thus can swing entirely clear of the window opening 11 in an emergency. The entire window opening 11 is then clear for easy, unobstructed escape of persons, in accordance with that earlier invention.

In accordance with the present invention, a cabinet is adapted to be affixed to an interior wall. A first bracket means 20 which is to be affixed rigidly to an interior surface 21 of the wall 10, as by means of multiple screw anchors 22, as shown. The first bracket means has a reinforced T-shape, with the head 23 of the T butting against the interior surface 21 of the wall 10. In cases of existing construction, the head 23 may be spaced from the wall surface 21 by a distance equal to the thickness of the surrounding frame 13. The base 24 of the T extends horizontally, away from the wall 10. An upper, outer edge 25 of the base 24 of the first bracket member 20 carries a hinge such as a piano hinge 26, for carrying a second, cover and step means 27 in pivotal relation to the first, bracket means 20. Beneath the base 24 of the bracket 20 is a reinforcing plate 28, which supports the base 24 in the storage position of the device 20, and which forms an abutment surface 29 for limiting the pivoting movement of the cover and step means 27.

The second, cover and step means 27, as shown in the drawing FIGS. 2 and 3, is generally L-shaped, with a vertical member 30 and a horizontal member 31, which are elongated, as well as end covers 32. The vertical member 30 is affixed at one of its sides to the hinge member 26 extending along the edge 25 of the first bracket means 20. The opposite side of the vertical member 30 is rigidly connected with the horizontal member 31, and both are braced by the end panels 32.

In the closed, storage position of FIGS. 1 and 2, the vertical member 30 extends above the base 24 of the bracket 20, and the horizontal surface 31 forms a working or table surface, such as might be used by a student. As shown, in the storage position, one side of the horizontal member 32 rests on the upper part of the base portion 23 of the bracket 20. In the deployed position, the cover and step member 27 is rotated about the hinge 26 along the edge 25 of the base 24 of the bracket 20, and into the position of FIG. 3. In such position, the member 27 forms a step on what is then the upper surface of the horizontal member 31. That step is supported in the deployed position by the rigid connection to the vertical member 30, by the end plates 32, and by the abutment of the vertical member 30 against the vertical surface 29 on the bracing member 28. The step 31 is preferably deployed a convenient height above the floor to the room shown in FIG. 1, so that a young or an elderly person is more easily able to gain access to the window opening 11.

Further in accordance with the invention, the device 20 comprises a second bracket means 35 which is normally stored in the space provided between the base 24 and upper part of the head 23 of the T-bracket 20 and the vertical and horizontal members 30, 31 of the cover and step means 27. The second bracket means 35 is pivotally connected to the upper edge of the head 23 of the first bracket 20, by a hinge 36 such as a second piano hinge extending along the common edge. A vertical member 37 is rigidly connected to a horizontal member 38, which in turn, at an outer end 40 thereof, is connected to a collapsible ladder 39. An upstanding member 41 in the orientation of FIG. 2 may be provided, if sufficient clearance is obtained through the window opening 11, especially through the lower part thereof.

In the storage position, shown in FIG. 2, the second bracket means 35 conveniently contains the collapsible ladder 39. That ladder is, for instance, a rope ladder, although chains or interlocking metal spacing pieces may be used, depending on space availability. Horizontal rungs 42 of the ladder 39 should be rigid, as of tubular metal, to assure ease of footing during an emergency descent.

When the ladder 39 is to be deployed, the cover and step means 27 is pivoted downwardly and to the left, in the orientation of FIG. 2. The ladder 39 is then exposed, it may be grasped in part and tossed through the window opening 11. The weight of the ladder as it pays out through the window will usually cause the second bracket means 35 to pivot upwardly and rightwardly through the window opening 11 provided only that the ladder's weight is greater than that of the bracket member 35. If the hinge 36 is close to the bottom edge 14 of the window opening 11, then the ladder will deploy automatically as the bracket means 35 is raised.

Once the second bracket member 35 is in the deployed position, the base 24 of the first bracket member 20 is exposed for use as a second step toward the level of the window opening 11. The upper part of the horizontal member 38 of the second bracket member 35 forms a further step through the window opening 11. It is also preferable to provide a hand hold (not shown) in the window opening 11, so that persons escaping through the opening 11 can steady themselves as they orient themselves to the uppermost rungs 42 of the ladder 39. Such a hand hold can take the form of hand grips concealed in the vertical side frames 13 surrounding the window 12, or as a portion of the ladder which drops down from above the window unit 12 when it is opened.

Although many minor modifications may be made to the particular form of the invention whose construction and operation are disclosed herein, all such minor modifications and other variations come within the scope and spirit of my invention, which are defined solely by the claims appended hereto. In particular, relative dimensions and materials may be varied and the sizes of the parts changed, without departing from my invention. Use of a cable wound on a governor controlled reel or motorized reel and carrying a chair or harness or similar device in lieu of a collapsible ladder as such is also within the scope of the invention.

I claim as my invention:

1. A method of affording emergency escape from an elevated enclosure to a lower level, comprising the steps:

providing a cabinet having a compartment formed by a top cover portion and a lower base portion therein beneath a window or door opening in an exterior wall of said enclosure;

storing a compact escape device such as a collapsible ladder in said compartment; and in an emergency, opening the cabinet to expose said ladder and to facilitate deployment thereof and to form first, second, and third stair treads, using said portions of the cabinet, leading from the floor of the enclosure through the exterior wall opening.

2. A fire escape ladder storage and deployment device for use in facilitating escape in case of emergency from a window opening elevated from a safe level in an exterior wall of a building, the device comprising, in combination, a first bracket means for securing a fire escape ladder in its stored and deployed positions, said bracket means being adapted to be affixed to an interior surface of the wall beneath and adjacent the window opening, said bracket means having a T-shape and comprising, a horizontally extending member having an outward edge spaced a distance from said wall surface, a rigid stop member also spaced at substantially said distance from said wall surface, and a top edge spaced below the opening and extending horizontally along the interior wall surface;

a cover and step means for covering the ladder when not needed for use and for hinging easily to uncover the ladder and to form a step surface for facilitating escape in an emergency, the cover and step means comprising, a first, flat member extending along the horizontal edge and hingedly connected to said edge for moving between a first, upper, vertical position to an inverted, second, lower, vertical position, and a second, flat member joined rigidly to the first member along a line spaced from the hinged connection and extending normally therefrom and toward the wall to overlie the first bracket means when the first member is in its upper position and extending away from the wall when the first member is in its lower position;

a second bracket means for holding the ladder in its stored position and for deploying the ladder for use, the second bracket means comprising, a first, flat member extending along and hingedly connected to the top edge of the first bracket means for moving between a lower, vertical, storage position to an upper, vertical, deployment position above the first bracket means and along the wall surface to a line horizontally adjacent the opening, and a second, flat member rigidly connected to and extending normally from the first flat member and along the horizontally extending member of the first bracket means in the storage position and entirely through the window or door opening in the wall in the deployed position; and a ladder having horizontal rungs and vertical members interconnecting and spacing the rungs at a maximum distance from one another, the ladder being of a length sufficient to reach from the opening in the wall to a lower, escape level, and the top of the ladder being connected by its vertical members to the second flat member of the second bracket means at a line thereon lying parallel to the wall and spaced outside the wall when the second bracket member is in its deployed position, whereby the ladder storage and deployment device serves as a ladder storage compartment and table surface when not in emergency use, facilitates easy deployment of the ladder through the adjacent window opening and forms access steps to said opening in an emergency requiring prompt escape.

3. The ladder storage and deployment device of claim 2, further comprising a fixed member carried on the outer edge of the second flat member of the second bracket means, said fixed member being upright in the storage position and extending downwardly in the deployed position and having the ladder attached thereto opposite the second flat member of said second bracket means; whereby to assist in maintaining the ladder within the confines of the second bracket member during a deployment operation.

* * * * *